United States Patent [19]

Noreus et al.

[11] 4,098,639

[45] Jul. 4, 1978

[54] PROCESS FOR REDUCING THE REQUIREMENT OF FRESH CHEMICALS WITHOUT INCREASING EMISSIONS IN THE PULPING OF CELLULOSIC MATERIAL

[75] Inventors: Sture Erik Olof Noreus, Husum; Lars Tage Uhlin, Ornskoldsvik, Sweden

[73] Assignee: Mo och Domsjo Aktiebolag, Ornskoldsvik, Sweden

[21] Appl. No.: 708,781

[22] Filed: Jul. 26, 1976

Related U.S. Application Data

[63] Continuation-in-part of Ser. No. 696,017, Jun. 14, 1976, abandoned.

[30] Foreign Application Priority Data

Jun. 17, 1975 [SE] Sweden ..... 7506965

[51] Int. Cl.[2] ..... D21C 11/10; D21C 11/12

[52] U.S. Cl. ..... 162/30 K; 55/73; 55/84; 162/31; 162/33; 162/35; 162/36; 162/38; 162/51; 162/82; 162/83; 162/87; 210/45; 210/60; 210/62; 210/63 R; 423/221; 423/480; 423/514; 423/539; 423/541 R; 423/567 R

[58] Field of Search ..... 162/29, 30 R, 30 K, 162/31, 35, 33, 36, 38, 65, 51, 82, 83, 90, 87; 55/36, 46, 73, 68, 83, 84, 89, 228; 210/42 R, 45, 56, 60, 62, 63 R, 65, 70; 423/478, 480, 482, 488, 514, 522, 539, 543, 541 R, 562, 571, 561, 477, 567 R, 182, 183, 207, 221, 242, 419, 421, 428; 159/47 WL

[56] References Cited

U.S. PATENT DOCUMENTS

| | | | |
|---|---|---|---|
| 1,996,363 | 4/1935 | Campbell et al. | 162/83 X |
| 2,071,304 | 2/1937 | Hirschkind | 162/83 X |
| 2,759,783 | 9/1973 | Samuelson et al. | 162/65 X |
| 2,772,240 | 11/1956 | Trobeck et al. | 162/30 K |
| 3,366,534 | 1/1968 | Rapson | 162/30 K |
| 3,574,052 | 4/1971 | Westerlund et al. | 162/87 X |
| 3,647,363 | 3/1972 | Chari et al. | 162/36 X |
| 3,654,071 | 4/1972 | Brannland et al. | 162/33 |
| 3,723,242 | 3/1973 | Barker | 162/82 X |
| 3,746,612 | 7/1973 | Rapson et al. | 162/30 R X |
| 3,950,217 | 4/1976 | Reeve | 162/30 K X |

OTHER PUBLICATIONS

Casey, *Pulp & Paper,* vol. I, 1960, pp. 498–502.

*Primary Examiner*—Arthur L. Corbin

[57] ABSTRACT

A process is provided for reducing the requirement of fresh chemicals without increasing emissions in the pulping of cellulosic material with alkaline sodium- and sulfur-containing-sulfate pulping liquor, which comprises evaporating and burning spent sulfate pulping liquor to obtain a smelt; dissolving the resulting smelt in water to form a sodium-sulfide-sodium carbonate-containing solution green liquor; regenerating pulping white liquor containing sodium sulfide and sodium hydroxide from said green liquor; and recirculating said regenerated white liquor to the pulping stage; oxidizing at least one of the resulting green and white liquors to form sodium thiosulfate therein; reacting the oxidized liquor with residual acid liquor, from the manufacture of chlorine dioxide by reduction of an alkali metal chlorate solution, to convert thiosulfate to sulfur dioxide and sulfur; removing and recovering formed sulfur dioxide; and returning the residual liquor, freed from sulfur dioxide, to the pulping.

12 Claims, 5 Drawing Figures

Figure 1:
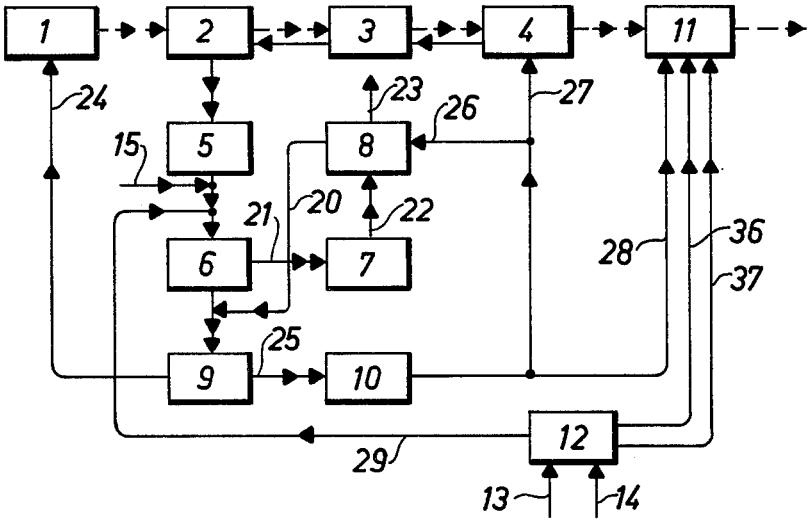

PROCESS FOR REDUCING THE REQUIREMENT OF FRESH CHEMICALS WITHOUT INCREASING EMISSIONS IN THE PULPING OF CELLULOSIC MATERIAL

This application is a continuation in part of Ser. No. 696,017, filed June 14, 1976, now abandoned.

The sodium and sulfur losses which occur during the pulping of cellulosic material with sodium-containing solutions are generally replaced, particularly in the sulfate pulping process, by supplying sodium sulfate to the recirculating chemical system. This results in the addition of both sodium and sulfur to the system. However, as a result of measures taken to reduce contamination of the atmosphere with sulfur-containing gases, sulfur may be retained in the system better than sodium, with the result that the sulfidity, i.e., the ratio of sulfur to sodium, increases above a desired level. As a result, the proportion of sodium must be increased, relative to the proportion of sulfur. This can be done in any of several ways.

Normally, sulfidity is controlled by adding sodium-containing chemicals which do not contain sulfur, such as sodium hydroxide, or sodium carbonate, but these chemicals are more expensive than sodium sulfate, with a resultant increase in the cost of operation of the process. If it is important to keep cost down, the use of sodium hydroxide or sodium carbonate must be kept to a minimum.

One way of keeping down the cost is to use as the source of sodium and/or sulfur cheap waste materials obtained from other processes.

One example of a waste material that is suitable for this purpose is the residual acid obtained in the manufacture of chlorine dioxide by reduction of sodium chlorate with sulfur dioxide in a sulfuric acid solution. The residual acid liquor contains sodium and sulfur, and can be recovered and used in the sulfate pulping process as a source of sodium and sulfur. This process is described for example in U.S. Pat. No. 3,654,071 to Brannland, Alsefelt and Gyllensten, patented Apr. 4, 1972. Such use of the residual acid leads to a reduction in pollution, since it avoids discharge of this acid as a waste material.

In a modern pulp mill, this residual acid liquor may constitute the sole makeup chemical for sodium and sulfur. Such waste acid liquor has a higher ratio of sulfur to sodium than sodium sulfate, and as a result the sulfidity problem is accentuated, when such residual acid liquor is used. The resulting excess of sulfur can be discharged as sulfur-containing gases to the atmosphere, but this merely converts what was previously a water contamination problem, due to discharge of the residual acid liquor from the chlorine dioxide production process, into an atmosphere contamination problem, due to the discharge of sulfur-containing gases from the sulfate pulping process.

A further problem arising from the use of this residual acid liquor is an increase in the chloride content of the pulping liquor. The chloride content increases, as the chemical losses in the pulping process are held to a minimum. The residual acid liquor contains minor quantities of chlorine compounds, in the form of sodium chloride and sodium chlorate, and these build up in the pulping process, as the amount of residual acid liquor added to replenish sodium and sulfur increases.

It has long been known that the pulp yield can be increased in the pulping of cellulose by the sulfate pulping process when sulfur is added to the pulping liquor, i.e. the white liquor, so as to produce sodium polysulfide in situ. An increase in yield without impairing the quality of the finished pulp is particularly desirable as the supply of raw wood decreases, and its cost continues to increase.

However, the difficulties in the control of sulfidity are increased when sulfur is added in the sulfate pulping process in order to produce polysulfide in the pulping liquor. This increases the amount of sulfur circulating in the system, and increases considerably the proportion of sulfur released to the atmosphere in the form of sulfur-containing gases. It is therefore necessary when a polysulfide liquor is used to recover sulfur, as elemental sulfur, and reuse it in the regeneration of pulping liquor.

Many methods have been proposed to control the sulfidity, and recover and reuse sulfur in the pulping process. According to U.S. Pat. No. 3,654,071 to Brannland, Alsefelt and Gyllensten, patented Apr. 4, 1972, the residual acid is mixed with white liquor or green liquor, thereby forming hydrogen sulfide. The hydrogen sulfide that is released can then be converted either to sulfur, or to sulfur dioxide, or to both. This method does however require the processing of large quantities of hydrogen sulfide, which is poisonous, and therefore dangerous to have present in a cellulose pulping mill in large quantities, in case of an accident.

The hydrogen sulfide is converted to sulfur dioxide by oxidation, burning it to sulfur dioxide. When the sulfur dioxide is to be used for the production of chlorine dioxide, it is necessary that this combustion be driven virtually to completion, since the chlorine dioxide process is extremely sensitive to the presence of reducing substances such as hydrogen sulfide. When the sulfur dioxide is to be used for the bleaching of pulp, it is also necessary that the combustion be virtually complete, since otherwise hydrogen sulfide will be released in the bleaching plant.

The sulfidity can be modified by using oxidized white liquor as an extraction agent in the bleaching of pulp, the extract being dumped as waste. This leads however to losses both of sulfur and of sodium in the waste liquor.

The control of chemical balance in the recycling of chemicals in a conventional sulfate pulping mill is illustrated in FIG. 1. The pulp is formed by pulping raw lignocellulosic material with white liquor (pulping liquor) in a conventional sulfate pulping process. The bleaching begins with an oxygen gas stage. The spent liquor from the bleaching stage is returned to the chemicals recovery system of the sulfate pulping stage in countercurrent flow through the screening and washing plants. To maintain sulfidity in the chemicals recovery system, the alkali used in the oxygen bleaching stage is oxidized white liquor. The white liquor is also used as a makeup chemical in the flue gas scrubber. Residual acid liquor from the chlorine dioxide production process is charged to the chemicals recovery system of the pulping process. A relatively large proportion of chlorine dioxide is also used for bleaching in a bleaching stage subsequent to the initial oxygen bleaching stage.

In the pulping digester 1 (the pulping stage), lignocellulosic material is pulped with pulping (white) liquor, an aqueous solution of sodium sulfide and sodium hydroxide. The ratio of sulfur to sodium (the sulfidity) in the white liquor is expressed mathematically by the formula $$(Na_2S/NaOH + Na_2S)$$

The sodium content is calculated as NaOH. A good pulping is obtained if the sulfidity lies within the range from about 0.3 to about 0.6. In a normal pulping, the sulfidity of the white liquor is about 0.4.

Subsequent to the pulping, the pulp is freed progressively from the pulping liquor in the washing stage 2, in the screening stage 3, and finally in the oxygen gas bleaching stage 4. This latter stage also incorporates a final washing of the partially bleached pulp with water or steam condensate. The chemicals recovery system begins with the evaporation stage 5 where water is removed from spent pulping liquor (black liquor) so that the solids content of the black liquor is increased to approximately 65%. The black liquor is then combusted in a soda furnace 6, the sodium and sulfur-containing pulping chemicals being recovered as a sodium carbonate-sodium sulfide smelt. The combustion gases are withdrawn by the line 21 through an electrostatic precipitator 7, and then by the line 22 to the scrubber 8, where the sulfur dioxide formed during the combustion process is recovered. The purified flue gases, now virtually sulfur-free, then are vented by the line 23 to atmosphere.

The sodium carbonate-sodium sulfide smelt is passed to the causticizing stage 9, where it can be dissolved in the aqueous liquor from the flue gas scrubber, which passes to the causticizing stage 9 by the line 20. Water can be added, if needed. The smelt is converted to white liquor by conversion of sodium carbonate to sodium hydroxide using calcium hydroxide or oxide. The white liquor that is obtained is now recycled by the line 24 to the pulping digester in stage 1.

A minor proportion of the white liquor from the causticizing stage 9 is withdrawn by the line 25 to a reactor 10, where it is oxidized, so that sodium sulfide is converted to sodium thiosulfate. The oxidized white liquor is passed by line 27 to the oxygen gas bleaching stage, where it is used as a source of alkali, and also by line 26 to the scrubber 8 for purifying the combustion gases. Depending upon the chemical balance, the oxidized white liquor can also be charged to the bleaching stage 11 by the line 28.

In the bleaching stage there is also used chlorine dioxide and sulfur dioxide water, both of which are produced at the chlorine dioxide production stage 12, and are conveyed to the bleaching stage 11 by the lines 36 and 37, respectively. The chlorine dioxide is manufactured by the reduction of sodium chlorate with sulfur dioxide in aqueous sulfuric acid solution.

The sulfur dioxide is obtained by burning sulfur, so that an aqueous sulfur dioxide solution is also produced. The residual acid liquor from the manufacture of chlorine dioxide is introduced into the chemicals recovery system of the pulping process upstream of the soda furnace 6 by the line 29.

The inlet lines 13 and 14 are for introduction of sulfur in the form of elemental sulfur and sulfuric acid, and sodium in the form of sodium chlorate. Any makeup chemicals needed in addition to those added as the residual acid liquor can be added to the system by the line 15.

The chemical balance, i.e., the input and output of chemicals from the system shown in FIG. 1, is illustrated in Table I:

TABLE I

| | INPUT | OUTPUT | | |
|---|---|---|---|---|
| | As residual acid from chlorine dioxide production | As liquor lost to waste | As withdrawal of oxidized white liquor | lost lost to atmosphere |
| | kg per ton pulp | | | |
| Sulfur | 16 | 2 | 1 | 13 |
| Sodium | 10 | 7 | 3 | 0 |

It is apparent from the data in the Table that for every 16 kg of sulfur introduced in the system, 13 kg of sulfur are discharged to atmosphere. For a sulfate pulping mill having an annual capacity of 300,000 tons, this amounts to approximately 7800 tons of sulfur dioxide discharged each year.

If part of the sodium hydroxide normally charged to the bleaching stage is replaced with oxidized white liquor, providing approximately 25 kg of sodium hydroxide per ton of pulp, and the waste bleaching liquor is discharged to waste, the following chemical balance is obtained:

TABLE II

| | INPUT | OUTPUT | | |
|---|---|---|---|---|
| | As residual acid from chlorine dioxide production | As liquor lost to waste | As withdrawal of oxidized white liquor | As gases lost to atmosphere |
| | kg per ton pulp | | | |
| Sulfur | 16 | 2 | 8 | 6 |
| Sodium | 10 | 7 | 24 | 0 |

In this system, when a deficiency of 21 kg of sodium per ton of pulp is added in the form of sulfur-free makeup, the release of sulfur to the atmosphere is cut in half, while the release of sulfur to waste is increased.

The discharge to waste of oxygen-consuming chemicals, taking into account pulping, screening and chemicals recovery, is extremely low in this process, and amounts to approximately 10 kg of BOD per ton of pulp. On the other hand, the discharge of waste liquor from the bleaching stage is a source of relatively serious contamination. To reduce this contamination, it has been proposed to recycle the waste liquor from the bleaching stage in whole or in part through the chemicals recovery system of the pulping process. However, the danger in this procedure is that the chloride may increase, until the chloride content is unacceptably high in the pulping system.

Various methods have been proposed to reduce chloride, but no method has yet been developed which can be applied to advantage in practice. Moreover, when the waste bleaching stage chemicals are returned to the chemicals recovery system of the pulping process, the amount of sulfur is also increased, and this results in a very large increase in the quantity of sulfur discharged to atmosphere as sulfur-containing gases.

The present invention provides a process for reducing the requirement of fresh chemicals, without increasing emissions, in the pulping of cullulose material with alkaline sodium- and sulfur-containing sulfate pulping liquor, comprising evaporating and burning spent sulfate pulping liquor; dissolving the resulting smelt in water to form a sodium-sulfide-sodium carbonate-containing green liquor; regenerating pulping white liquor containing sodium sulfide-sodium hydroxide from said liquor; and recirculating said regenerated white liquor to the pulping stage; oxidizing at least one of the resulting green and white liquors to form sodium thiosulfate therein; reacting the residual acid liquor, from the manufacture of chlorine dioxide by reduction of an alkali metal chlorate solution, with oxidized white and/or green liquor to form sulphur dioxide and sulfur; removing and recovering sulfur dioxide and returning the residual acid liquor, freed from sulfur dioxide, to the pulping.

In a preferred embodiment of the invention, the oxidized white and/or green liquor can be used as an alkaline scrubbing liquid in the purification of the combustion gases, and thereafter reacted with the residual acid liquor. The sulfur dioxide that is obtained can be used to generate chlorine dioxide, either directly and/or after having been converted to sulfuric acid. The sulfur dioxide can also be charged for example to one or more of the alkali extraction and/or bleaching stages.

The elemental sulfur that is formed can be separated and combined with a white liquor and/or green liquor to form polysulfide. This sulfur can be supplemented by elemental sulfur from an external source. Elemental sulfur formed in the process can also be converted to sulfur dioxide, which can then be used as described above.

The residual acid liquor, after removal of sulfur dioxide, can be processed to remove chloride ions and then recycled to the pulping so that chloride ions are not added to the system. This can be done for example by evaporating the residual acid liquor, after removal of sulfur dioxide, in a manner such that the alkali metal salts contained therein, except alkali metal chloride, are precipitated out. The residual alkali metal chloride solution is then removed, after which the precipitated alkali metal salts are recycled to the pulping process. The chloride solution that is obtained can be reacted with sulfuric acid, and the hydrogen chloride that is formed is expelled. The hydrogen chioride can be recovered, and used as a reducing agent in the chlorine dioxide generation process.

The residual acid liquor from the manufacture of chlorine dioxide is reacted with oxidized white and/or green liquor which has been used to scrub sulfur-containing gases in the flue gas scrubber. This has several advantages. The sulfur dioxide which has been absorbed in the flue gas scrubber is directly expelled, and can be used in the manufacture of chlorine dioxide, or for the manufacture of sulfur dioxide in the bleaching stage. The thiosulfate formed upon oxidation of white liquor is decomposed in accordance with the equation $$S_2O_3^{--} + 2H^+ \rightarrow H_2O + SO_2 + S$$

Thus, an important advantage in the process of the invention is that the sulfur dioxide is obtained directly, in gaseous form, without first passing through a hydrogen sulfide stage, thus avoiding the formation of poisonous hydrogen sulfide.

A further advantage is that subsequent to removing the elemental sulfur, and passing the sulfur to a white liquor and/or green liquor for the preparation of polysulfide, the residual acid liquor can be enriched with nondeleterious chloride ions removed elsewhere from the system, and then dumped to waste, or used for the manufacture of bleaching chemicals. This can for example be accomplished by repeated concentration and precipitation of salts other than chloride, such as sodium sulfate. The precipitated salts can be recycled for use in the manufacturing of white or green liquor, either directly or subsequent to being dissolved in water or a suitable liquor. The separated sodium chloride solution can also be used in the preparation of chlorine dioxide by addition of concentrated sulfuric acid, thus forming and driving off hydrogen chloride gas, which can be used directly both as a reducing agent and as a proton donor in the chlorine dioxide preparation stage.

Oxidized liquor is obtained by oxidizing the white and/or green liquor with air at an elevated temperature, and is utilized as a source of alkali in the process of the invention.

Preferably, the liquor is oxidized at a temperature within the range from about 50°° to about 130° C by injecting air into the solution, while maintaining the air flow at a rate to agitate the solution within the range from about 50 to about 500 $Nm^3/hm^2$.

In another preferred embodiment, the liquor is oxidized at a temperature within the range from about 70° to about 110° C, in one or more reactors connected in series, by injecting air into the liquor in a manner to maintain the liquor in motion, the pressure of the air at the top of the reactor exceeding atmospheric pressure by at most 5 bars and the air load being within the range from about 100 to about 400 $Nm^3/hm^2$ calculated on the projected bottom surface of the reactor, and the oxidized solution, optionally after purifying the same, is used as an alkali for reaction in the process of the invention.

Surprisingly, white and/or green liquor can be readily oxidized on a large scale, despite the fact that tests made on laboratory scale have shown that the oxidation of sodium sulfide is quite difficult.

Several methods are available whereby a gas can be contacted by a liquid. For example bubbles of gas can be caused to pass through a liquid or a finely-divided liquid in droplet form, for instance, from spray nozzles, can be contacted with gas, or an ejector or venturi device can be used in which liquid and gas are mixed.

The simplest method in this respect is to cause air or some other oxygen-containing gas to bubble through a layer of liquor. This method works well in practice. In order for a good result to be obtained it is necessary to ensure, among other things, that a suitable temperature is maintained, that the contact time between the gas and the liquid phase is sufficient, and that there is a sufficiently high gas load. Sulfide can be removed quantitatively when treating white liquor in accordance with the above. An important fact is that alkali is not consumed during this treatment process.

The following Examples illustrate the oxidation of white liquor on a laboratory scale, and the oxidation of white liquor on a plant scale.

EXAMPLE A

This Example is a laboratory test demonstrating the batchwise oxidation of white liquor with air.

The tests were made in a reactor comprising a glass tube 2 meters in height and 50 mm inner diameter. At the bottom of the reactor there was arranged a capillary having an inner diameter of 2 mm and through which air could be passed. An immersion heater was used in direct contact with the white liquor to heat the same. A cooler was mounted at the top of the reactor to reduce evaporation losses from the white liquor. 800 ml of white liquor obtained from a sulphate plant was charged to the reactor. The white liquor was heated to the desired temperature before being treated with air and the amount of $Na_2S$ in grams per liter in the treated liquor determined after the treatment. The air pressure at the top of the reactor was 1.1 bars.

The results obtained are given in Table A.

From these results it is seen that an elevated temperature speeds up the sulfide oxidation, and that an increase in air supply also provides for a more rapid reaction. The reaction rate is greatly increased by adding a small quantity of black liquor. The effect obtained by the addition of other substances such as manganese, iron or nickel ions is small, as is also the effect obtained with the addition of iron shavings or filings or acid-proof steel filings. The quickest reaction without the addition of a catalyst was obtained with an air load of 600 l/h corresponding to 300 $Nm^3/hm^2$. If the load is increased further, to above roughly 500 $Nm^3/hm^2$, the liquid can no longer be retained in the reactor. Despite the high temperature, 95° C, and the high air load, a reaction time of several hours is necessary to completely convert the sulfide. The result would thus appear to indicate that a plant would need to operate at very high air loads and long residence times if no catalyst, such as black liquor, is used.

TABLE A

| Run No. | Temperature ° C | Air Flow l/h | Air Flow $Nm^3/hm^2$ | Catalyst addition | Liquid height meters | Time minutes | $Na_2S$ g/l |
|---|---|---|---|---|---|---|---|
| 1 | 95 | 200 | 100 | — | 0.6 | 0 | 47.0 |
| | | | | | | 30 | 44.5 |
| | | | | | | 60 | 43.0 |
| | | | | | | 120 | 39.2 |
| 2 | 95 | 400 | 200 | — | 0.6 | 0 | 46.4 |
| | | | | | | 30 | 43.5 |
| | | | | | | 60 | 40.8 |
| | | | | | | 120 | 34.8 |
| 3 | 95 | 600 | 300 | | 0.6 | 0 | 46.3 |
| | | | | | | 30 | 43.3 |
| | | | | | | 60 | 40.2 |
| | | | | | | 120 | 32.1 |
| 4 | 95 | 200 | 100 | Black liquor 1% | 0.6 | 0 | 45.9 |
| | | | | | | 60 | 30.0 |
| | | | | | | 120 | 14.4 |
| 5 | 95 | 200 | 100 | 5 ppm Ni | 0.6 | 0 | 45.9 |
| | | | | | | 30 | 43.1 |
| | | | | | | 250 | 30.3 |
| 6 | 95 | 200 | 100 | Fe chips | 0.6 | 0 | 46.6 |
| | | | | | | 30 | 43.8 |
| | | | | | | 60 | 41.0 |
| | | | | | | 120 | 36.7 |
| 7 | 95 | 200 | 100 | Chips of stainless steel SIS 2343 | 0.6 | 0 | 47.6 |
| | | | | | | 30 | 44.7 |
| | | | | | | 60 | 43.1 |
| | | | | | | 90 | 42.4 |
| 8 | 95 | 200 | 100 | 5 ppm Mn | 0.6 | 0 | 44.3 |
| | | | | | | 30 | 42.1 |
| | | | | | | 60 | 38.7 |
| | | | | | | 120 | 33.5 |
| 9 | 50 | 400 | 200 | — | 0.6 | 0 | 47.0 |
| | | | | | | 30 | 46 |
| | | | | | | 60 | 45.5 |
| | | | | | | 120 | 45.0 |

EXAMPLE B

This Example is a plant scale batchwise treatment of white liquor with air.

The tests were made in a reactor comprising a 6 m high vessel having a diameter of 300 mm. A gas distributor was arranged at the bottom of the reactor, to allow air or some other gas to be introduced to the reactor. Means were provided to enable the liquid in the reactor to be heated indirectly to the desired temperature by steam. The gas passing through the liquid is freed from liquid droplets before being released to atmosphere. The desired amount of white liquor was charged to the reactor and the temperature adjusted by means of steam, after which the treatment with air was commenced. The air pressure at the top of the reactor was 6 bars.

The results are shown in Table B.

TABLE B

| Run No. | Temperature ° C | Air Flow $Nm^3/h$ | Air Flow $Nm^3/hm^2$ | Liquid height meters | Time minutes | $Na_2S$ g/l |
|---|---|---|---|---|---|---|
| 1 | 50 | 5 | 70 | 2 | 0 | 39 |
| | | | | | 60 | 31.5 |
| | | | | | 120 | 26.5 |
| 2 | 95 | 5 | 70 | 2 | 0 | 43 |
| | | | | | 60 | 28.5 |
| | | | | | 120 | 13 |
| 3 | 95 | 5 | 70 | 5 | 0 | 43 |
| | | | | | 60 | 15 |
| | | | | | 120 | 1 |
| 4 | 95 | 35 | 490 | 2 | 0 | 45 |
| | | | | | 30 | 21 |
| | | | | | 45 | 3 |
| | | | | | 60 | 0.1 |
| 5 | 95 | 35 | 490 | 5 | 00 | 45 |
| | | | | | 30 | 10 |
| | | | | | 45 | 0.1 |

It is evident from the Table that sulfide is destroyed very rapidly, even with moderate gas loads, for example in Run No. 3, and that it is technically possible to treat white liquor with air to obtain a very low sulfide content. The tests also show that the temperature can be relatively low, around 50° C, but that it is an advantage to have a high reaction temperature from 60° to 100° C. It is also evident that it is an advantage to have a deep liquid layer. The results shown in Table B could not be anticipated from the results obtained with the tests described in Example A. The results obtained on a large scale are surprisingly good.

The Examples show that various methods can be used to oxidize white liquor and that the proposed fields of use are realistic. Prior to the oxidation step, the white liquor used in the tests had a sodium sulfide content of 35 to 50 g $Na_2S$ per liter, a sodium thiosulphate content of 5 to 10 g $Na_2S_2O_3$ per liter, and a content of titratable alkali expressed as sodium hydroxide of 100 to 130 g/l.

Subsequent to oxidizing the white liquor, it was possible to reduce the sulfide content to 0 to 1 g $Na_2S$ per liter, the sodium thiosulphate content was 35 to 50 g $Na_2S_2O_3$ per liter, and the alkali content expressed as NaOH was 100 to 130 g/l.

Tests carried out on a full scale show that it is an advantage to use a high liquid column, over 5 meters, through which air can flow and that the reaction rate increases if pure oxygen gas or air under elevated pressure is used. The air pressure must be greater than that caused by the height of the liquid column, in order for the air to to pass through the reactor. For practical reasons it may be suitable, however, to establish a relatively low overpressure at the top of the reactor, so that the pressure prevailing at the top of the reactor is only as high as that necessary to enable the separation of liquid droplets in a demister, and which results from the conduit system in which the residual gas is passed to atmosphere. Thus, an air pressure of up to 5 bars usually is suitable, but higher pressures may in certain circumstances be advantageous.

It is, of course, possible to use other methods for contacting the gas and liquid than the method of blowing air into the white liquor through a perforated gas distributor. For example, an air lift pump can be used to further improve the contact between gas and liquid. The air may also be atomized by mechanical devices of another type, e.g. rotating discs or propellers. Research carried out during the development of the present invention has shown, however, that a sufficiently good result is obtained with a gas distributor provided with small orifices, excessively small orifices being unsuitable owing to the risk of blockages occurring and owing to a high pressure drop. Excessively large orifices are also unsuitable owing to the fact that with large orifices the contact between liquid and gas is poor. A suitable orifice diameter is from 1 to 10 mm.

It has been found that when using chlorine and/or chlorine dioxide, particularly with oxygen-gas bleaching processes, the presence of trace substances, such as iron, cobalt, nickel and manganese, for example, can influence the quality of the pulp. consequently it is, in certain instances, convenient to remove solid particles from the oxidized white liquor by filtering, or decanting. To remove from the white liquor foreign substances dissolved therein, chemicals can be added which form flocs on which the impurities are absorbed. Chemicals which can be used in this way include magnesium, zinc and calcium compounds. Polyelectrolytes or silicates can be used instead of or in combination with these chemicals.

To improve efficiency of the oxidation process, several reactors can be connected together in series, the white liquor being passed from one to the other of the reactors in series. Air can also be caused to pass through the reactors in series, or alternatively, fresh air can be charged to each reactor. If the white liquor is very pure, it may be difficult to get the sulfide to react. In this case it is suitable to add catalysts, such as iron, manganese or nickel compounds or organic substances, such as black liquor, to expedite the oxidation process.

Chlorine dioxide is normally produced by reaction of alkali metal chlorate with a reducing agent in an aqueous acidic reaction medium. The chlorate is normally sodium chlorate, although potassium chlorate can also be used; however, sodium chlorate is preferred due to the ease of dissolution of sodium chlorate.

The sodium chlorate solution is usually produced by electrolysis of aqueous sodium chloride solution, or by dissolving solid sodium chlorate in water. Sulfur dioxide is preferred as the reducing agent, although methanol can also be used, and the inorganic acid is usually sulfuric acid. If sodium chloride is present, it can also serve as a reducing agent.

The principal reactions resulting in the formation of chlorine dioxide in which sodium chloride, sulfur dioxide and methanol, respectively, act as the reducing agent are as follows:

$$NaClO_3 + NaCl + H_2SO_4 \rightarrow ClO_2 + 0.5Cl_2 + Na_2SO_4 + H_2O \quad 1.$$

$$2NaClO_3 + SO_2 \rightarrow 2ClO_2 + Na_2SO_4 \quad 2.$$

$$2NaClO_3 + CH_3OH + H_2SO_4 \rightarrow 2ClO_2 + HCHO + \lambda\ Na_2SO_4 + 2H_2O \quad 3.$$

The highest theoretical yield possible is one mole of chlorine dioxide for each mole of sodium chlorate reacted. As a by product of this reaction ½ mole of chlorine is also produced, when the reducing agent is sodium chloride, and this chlorine can be disposed of as a byproduct, for use, for example, as a bleaching agent.

In addition to the desired reactions, side reactions may also take place, of which the principal side reactions are as follows:

$$NaClO_3 + 5NaCl + 3H_2SO_4 \rightarrow 3Cl_2 + 3Na_2SO_4 + 3H_2O \quad 4.$$

$$2NaClO_3 + 6SO_2 + 6H_2O \rightarrow 2HCl + 5H_2SO_4 + Na_2SO_4 \quad 5.$$

$$2NaClO_3 + 3CH_3OH + H_2SO_4 \rightarrow 2HCl + Na_2SO_4 + 3HCHO + 3H_2O \quad 6.$$

Each of these reactions results in a loss of chlorate by conversion into a less expensive chemical, and it is desirable for economic reasons to minimize these side reactions. However, it is virtually impossible to completely eliminate these side reactions, which normally take place concurrently with the chlorine dioxide-forming reaction, since the starting materials are the same, and the reactions take place under the same conditions in aqueous acidic medium.

The acidic residual liquor from this reaction, after separation of chlorine dioxide accordingly, is a complex mixture of unreacted starting materials, acids, including hydrochloric and sulfuric acid, and by-products of the reaction. It is however composed of substances commonly also present in the sulfate pulping liquor and chemicals recovery system, such as sodium sulfate, and substances that are nondeleterious when present in controlled amounts in such liquor, such as chlorides, and it is quite acidic, having a hydrogen ion content from about 3 moles to about 20 moles per liter. It is therefore useful as a source of acid and sodium- and sulfur-containing chemicals, supplementing the supply of these chemicals in the oxidized liquor in the reaction with oxidized liquor.

The reaction between the residual acid liquor and oxidized liquor is effected at an elevated temperature at which thiosulfate is converted to sulfur dioxide and sulfur. The reaction is carried out at a temperature within the range from about 30° to about 130° C, preferably from about 40° to about 80° C, in one or more reactors connected in series. The reaction can be conducted batchwise, or continuously blending the liquor at one end of a reactor and continuously withdrawing reaction product at the other end of the reactor at a flow rate to maintain therein a dwell time as required for the reaction. The reaction time can vary from several minutes to several hours; the time is in no way critical.

The residual acid liquor is used in an excess, well beyond stoichiometric, to ensure conversion of the thiosulfate in the oxidized liquor.

Preferred embodiments of the invention are illustrated in the following Examples.

EXAMPLE 1

Figure 2:
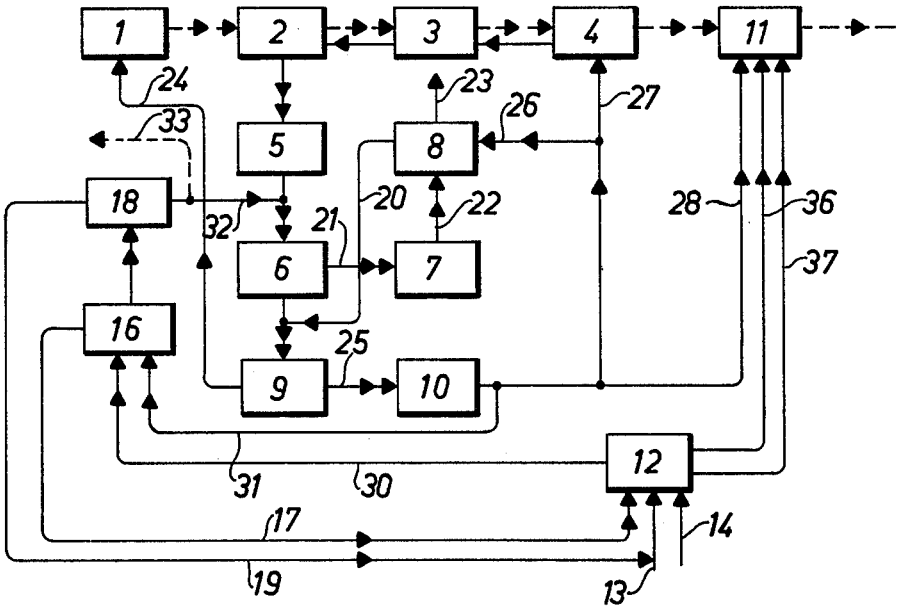

This example illustrates a process carried out using the system of FIG. 2. This system utilizes the same combination of digester, washing, screening, oxygen bleaching and final bleaching stages as shown in the system of FIG. 1, but the chemicals recovery system is different. The system utilizes a reactor 16 in which the residual acid liquor from the chlorine dioxide production stage 12 and the oxidized white liquor from reactor 10 are reacted, the thiosulfate ions in the oxidized white liquor being converted to sulfur dioxide and elemental sulfur, in accordance with the equation:

$$S_2O_3^{--}\ 30\ 2H^+ \rightarrow SO_2 + S + H_2O$$

The residual acid liquor is led from stage 12 to the reactor 16 by the line 30, and the oxidized white liquor is led from the reactor 10 to the reactor 16 by the line 31. The sulfur dioxide liberated in reactor 16 is returned directly to the chlorine dioxide manufacturing stage 12 by the line 17. The elemental sulfur is separated in the sulfur recovery stage 18, and returned to the chloride dioxide manufacturing stage 12 by the line 19. The residual liquor from the reactor 16 and the separator 18 is led by the line 32 to the chemicals recovery system just before the soda furnace 6 of the pulping system.

At a sulfidity of 0.4, it has been found possible to operate this system so as to reuse 6 kg of sulfur per ton of pulp, divided so that half the amount of sulfur is obtained in the form of sulfur dioxide through the line 17, and half is obtained as elemental sulfur through the line 19. The ability to recycle this large amount of sulfur means that the amount of sulfur introduced into the system from an external source can be correspondingly reduced.

The following chemicals balance can be set up, if it be assumed that the same chemicals sources are obtained as those described in conjunction with the system of FIG. 1:

TABLE III

| | INPUT | OUTPUT | | |
|---|---|---|---|---|
| | As residual acid from chlorine dioxide production | As liquor lost to waste | As withdrawal of oxidized white liquor | As gases lost to atmosphere |
| | kg per ton pulp | | | |
| Sulfur | 10 | 2 | 1 | 7 |
| Sodium | 10 | 7 | 3 | 0 |

It is apparent that in this system the release of sulfur to the atmosphere as sulfur-containing gases has been cut practically in half, as compared to FIG. 1. Even this loss of sulfur can be reduced further by using sulfur-free makeup chemicals, with an increased withdrawal of oxidized white liquor to the bleaching stage, as described in the system in FIG. 1.

The system of FIG. 2 can also be applied to a pulping system that does not include a flue gas scrubber. In such a system, to obtain the same chemical balance, there must be used an oversized soda furnace 6, which operates in a manner such that a relatively small amount of sulfur dioxide escapes with the flue gases. A disadvantage of this, however, is that the heat content of the flue gases is not utilized.

In the system of FIG. 2, the residual solution can be treated in different ways for removing chloride from the chemicals recovery system, subsequent to the separation of sulfur dioxide and elemental sulfur at 16 and 18, respectively. Repeated concentration of the residual solution from 18 results in the precipitation of sodium salts, leaving a sodium chloride solution. The sodium chloride solution can be removed by the line 33. The precipitated salts may be recycled to the chemicals recovery system, either directly, or after being dissolved in water or a suitable liquid.

EXAMPLE 2

Figure 3:
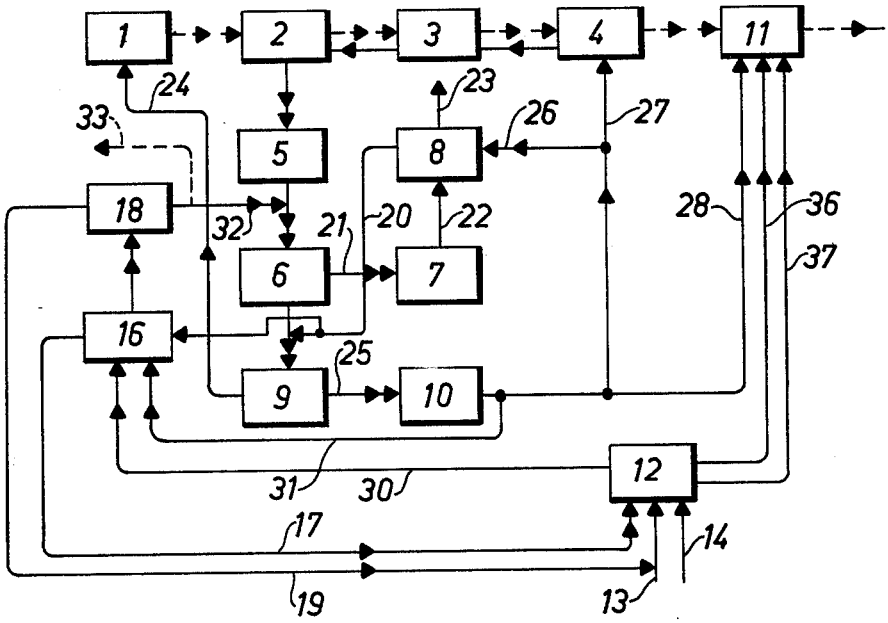

Another embodiment of the process of the invention is shown in the system of FIG. 3, which represents a sulfate pulping system similar to that shown in FIG. 2, and provided with a flue gas scrubber 8 in which oxidized white liquor was used as the scrubbing liquid. The oxidized white liquor from the scrubber was removed by line 20, and reacted in the reactor 16 with waste acid liquor from the chlorine dioxide manufacturing stage 12. At a sulfidity of 0.4, an amount of sulfur dioxide corresponding to approximately 13 kgs of sulfur per ton of pulp could be expelled in the reactor 16, and returned to the chlorine dioxide preparation stage 12 by way of the line 17. In a manner similar to that applied in the system of FIG. 2, a further 3 kg of sulfur per ton of pulp could be obtained from the separator 18. Since in this case the losses were as high as previously described, the following chemical balance was obtained:

TABLE IV

| | INPUT | OUTPUT | | |
|---|---|---|---|---|
| | As residual acid from chlorine dioxide production | As liquor lost to waste | As withdrawal of oxidized white liquor | As gases lost to atmosphere |
| | kg per ton pulp | | | |
| Sulfur | 0 | 2 | 1 | 0 |
| Sodium | 10 | 7 | 3 | 0 |

In this system, when operated as described, there was a sulfur deficiency. The sulfidity had begun to fall, which means that the sulfide content in both the white liquor and the oxidized white liquor had decreased. Consequently the quantity of reused sulfur also decreased, since smaller quantities of sulfur in the form of sulfur dioxide and elemental sulfur were obtained in the reactor 16. The balance thus self-adjusted to an excessively low sulfidity level.

This problem was overcome by adding elemental sulfur into the chemical system by the line 32. Thus, only the sulfur obtained as sulfur dioxide in the reactor 16 was reused.

The problem could also be resolved by passing a portion of the scrubber liquid to the reactor 16 by the line 20; the remaining portion is fed into the chemicals recovery system at just before the causticization stage 9.

As is evident in this Example it is possible in accordance with the invention to greatly reduce the sulfur discharge to waste while at the same time adjusting the sulfidity to the desired high level without departing from the requirement of low sulfur emissions to atmosphere. In accordance with the invention, sodium chloride could also be removed from the system by line 33, which is particularly favorable, inasmuch as an enrichment of sodium chloride in the system takes place in the liquid used for purifying the flue gases.

EXAMPLE 3

As is evident from the results shown in Example 2, it is possible to operate the process of the invention in a manner such that large quantities of sulfur are reused, and a sulfur deficiency results. If the initial sulfur intake is not increased, the sulfidity will fall. The present Example illustrates the addition of sulfur from an external source, in order to increase the sulfidity and provide a pulping liquor containing polysulfide.

Figure 4:
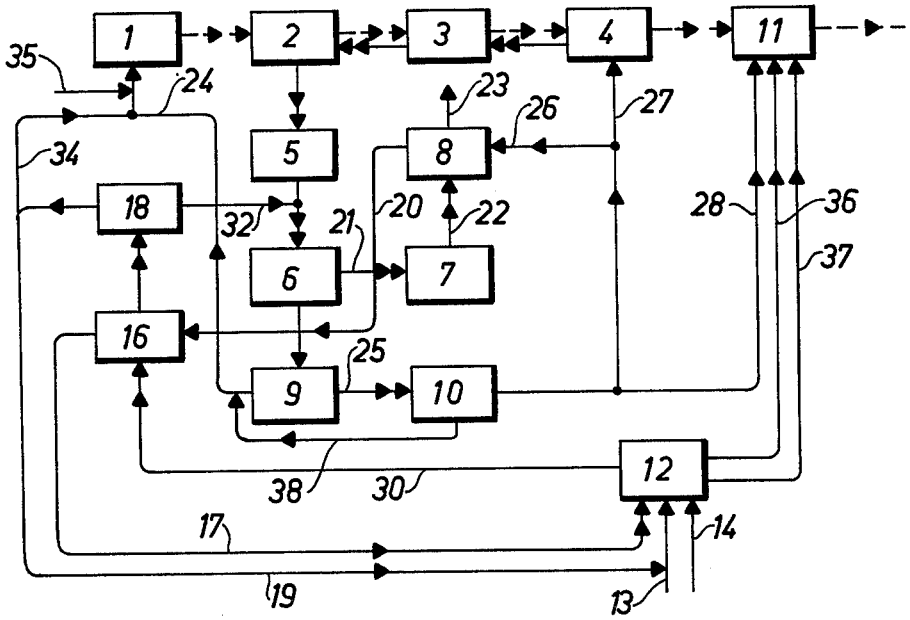

The system shown in FIG. 4 is an illustration of this embodiment. The pulping system shown there is similar to that described in FIG. 2, but the elemental sulfur separated in the sulfur recovery stage 18 is mixed with white liquor from the line 34 for the preparation of polysulfide. In order to increase the content of polysulfide, elemental sulfur is added to the system by line 35, from an external source. The polysulfide content is increased by a careful oxidation of white liquor with air in the reactor 10. The partially oxidized white liquor was withdrawn by the line 38, after passing through only a portion of the reactor 10, and returned to the digester 1.

Tests showed that there was obtained a polysulfide sulfur content in the white liquor corresponding to 2% based on the starting wood, when elemental sulfur from the sulfur recovery stage 18, sulfur from the external source, and polysulfide-containing solution were charged to the sytem, the sulfur from the external source being charged through the line 35, and the polysulfide-containing solution through the line 38. In this way, the pulp yield was increased by 3%, calculated on the wood, compared with a normal sulfate cooking process, such as that of FIG. 1.

The chemical balance for this system is shown in Table V:

TABLE V

| | kg per ton pulp | |
|---|---|---|
| | S | Na |
| Input | | |
| As elemental sulfur | 16 | 0 |
| As waste acid liquor from chlorine dioxide manufacture | 0 | 10 |
| Output | | |
| As liquor lost to waste | 4 | 7 |
| As withdrawal of oxidized white liquor | 2 | 3 |
| As withdrawal of sulfur as $SO_2$ and/or $H_2SO_4$ | 7 | 0 |
| As gases lost to atmosphere | 3 | 0 |

The sulfidity level was higher than in Examples 1 and 2, and hence more sulfur was lost to waste, and more sulfur could be expelled in the reactor 16. Approximately 23 kg of sulfur was expelled in the reactor 16 as sulfur dioxide, but only 16 kg of sulfur in the form of both sulfur dioxide and sulfuric acid was required for the manufacture of chlorine dioxide. The surplus, 7 kg of sulfur per ton of pulp, could be used in the extraction stages in the bleaching stage, or could be converted to sulfuric acid for sale commercially.

EXAMPLE 4

Figure 5:
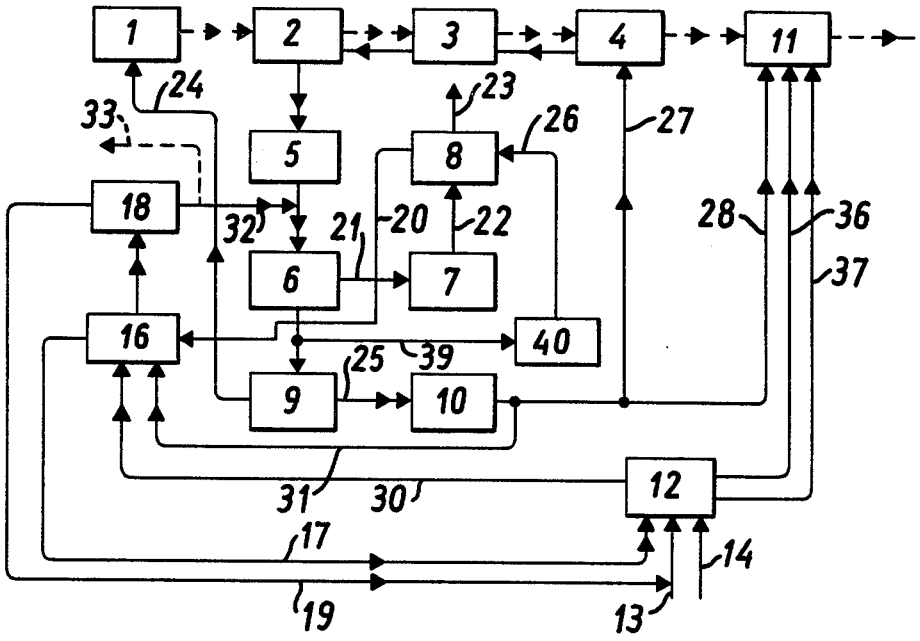

Another embodiment of the process of the invention in which oxidized green liquor is used is shown in the system of FIG. 5, which represents a sulfate pulp system similar to that shown in FIG. 3, and provided with a flue gas scrubber 8 in which oxidized green liquor was used as the scrubbing liquid. The green liquor was removed after the soda furnace 6, and before the causticizing stage 9, and passed in a line 39 to the reactor 40, where the sulfide in the green liquor was oxidized to thiosulfate. The oxidized green liquor was then passed via line 26 to the scrubber 8, and used scrubber liquid was passed to reactor 16 via line 20.

At a sulfidity of 0.4, an amount of sulfur dioxide corresponding to approximately 13 kgs of sulfur per ton of pulp could be expelled in the reactor 16, and returned to the chlorine dioxide preparation stage 12 by way of line 17. In a manner similar to that applied in the system of FIG. 2, a further 3 kg of sulfur per ton of pulp could be obtained from the separator 18. Since in this case the losses were as high as previously described, the following chemical balance was obtained:

TABLE VI

| | INPUT | OUTPUT | | |
|---|---|---|---|---|
| | As residual acid from chlorine dioxide production | As liquor lost to waste | As withdrawal of oxidized white liquor | As gases lost to atmosphere |
| | kg per ton pulp | | | |
| Sulfur | 0 | 2 | 1 | 0 |
| Sodium | 10 | 7 | 3 | 0 |

In this system, when operated as described, there was a sulfur deficiency. The sulfidity had begun to fall, which means that the sulfide content in both the green liquor and the oxidized green liquor had decreased. Consequently the quantity of reused sulfur also decreased, since smaller quantities of sulfur in the form of sulfur dioxide and elemental sulfur were obtained in the reactor 16. The balance thus was self-adjusted to an excessively low sulfidity level.

This problem was overcome by adding elemental sulfur into the chemical system by the line 32. Thus, only the sulfur obtained as sulfur dioxide in the reactor 16 was reused.

The problem could also be resolved by passing a portion of the scrubber liquid to the reactor 16 by the line 20; the remaining portion is fed into the chemicals recovery system at just before the causticization stage 9.

In addition to the residual acid solutions obtained from the manufacture of chlorine dioxide, the process of the invention is also applicable using other types of acid solutions supplied to the system from external sources.

Having regard to the foregoing disclosure, the following is claimed as the inventive and patentable embodiments thereof:

1. In a process for reducing the requirement of fresh chemicals without increasing emissions in the pulping of cellulose material with alkaline sodium-and sulfur-containing sulfate pulping liquor; in which chemicals recovery comprises evaporating and burning spent sulfate pulping liquor to obtain a smelt; dissolving the resulting smelt in water to form a sodium sulfide-sodium carbonate-containing green liquor; regenerating pulping white liquor containing sodium sulfide-sodium hydroxide from said green liquor; and recirculating said regenerated white liquor to the pulping stage; the improvement which comprises oxidizing at least one of the green and white liquors to form sodium thiosulfate therein; reacting the oxidized liquor with residual acid liquor, from the manufacture of chlorine dioxide by reduction of an alkali metal chlorate solution, at a temperature within the range from about 30° to about 130° C to convert thiosulfate to sulfur dioxide and sulfur; removing and recovering formed sulfur dioxide; and returning the residual acid liquor, freed from sulfur dioxide, to the pulping.

2. A process according to claim 1, in which the oxidized liquor is used as an alkaline scrubbing liquid for purification of combustion gases formed during said burning of spent sulfate pulping liquor, and thereafter reacted with the residual acid liquor.

3. A process according to claim 2, in which the sulfur dioxide that is removed and recovered is used to generate chlorine dioxide.

4. A process according to claim 2, in which the sulfur dioxide that is removed and recovered is converted to sulfuric acid and the sulfuric acid is used to generate chlorine dioxide.

5. A process according to claim 1, in which sulfur that is formed is separated and combined with a white liquor and/or a green liquor to form polysulfide.

6. A process according to claim 5, in which, in addition to the formed sulfur, sulfur from an external source is combined with said white liquor and/or green liquor to form polysulfide.

7. A process according to claim 1, in which sulfur that is formed is converted to sulfur dioxide.

8. A process according to claim 1, in which the residual acid liquor, after removal of sulfur dioxide, is processed to remove chloride ion, and then recycled to the pulping so that chloride ions are not added to the system.

9. A process according to claim 8, which comprises evaporating the residual acid liquor, after removal of sulfur dioxide, so that alkali metal salts contained therein, except alkali metal chloride, are precipitated out and recovered, removing the residual acid liquor containing alkali metal chloride and recycling the precipitated alkali metal salts to the pulping process.

10. A process in accordance with claim 9, which comprises reacting the recovered alkali metal chloride with sulfuric acid and using hydrogen chloride as a reduction agent in the generation of chlorine dioxide.

11. A process according to claim 1, which comprises supplying the removed and recovered sulfur dioxide to a cellulose pulp bleaching stage which contains extraction and bleaching steps.

12. A process according to claim 11, which comprises supplying the removed and recovered sulfur dioxide to one of the extraction and bleaching steps in the bleaching stage.

* * * * *

UNITED STATES PATENT AND TRADEMARK OFFICE

CERTIFICATE OF CORRECTION

PATENT NO. : 4,098,639

DATED : July 4, 1978

INVENTOR(S) : Sture Erik Olof Noreus et al

It is certified that error appears in the above-identified patent and that said Letters Patent are hereby corrected as shown below:

[56] line 3 : "2,759,783" should be --3,759,783--

Column 4, Table I, last column, line 5 : "lost", first occurrence, should be --As gases--

Column 4, line 62 : "cullulose" should be --cellulose--

Column 5, line 21 : After "with" please delete "a"

Column 9, lines 52-53 : "$NaClO_3 + NaCl + H_2SO_4 \rightarrow ClO_2 + 0.5Cl_2 + Na_2SO_4 + H_2O$" should be --$NaClO_3 + NaCl + H_2SO_4 \rightarrow ClO_2 + 0.5Cl_2 + Na_2SO_4 + H_2O$-- line 57 : "$2NaClO_3 + CH_3OH + H_2SO_4 \rightarrow 2ClO_2 + HCHO + \lambda Na_2SO_4 + 2H_2O$" should be --$2NaClO_3 + CH_3OH + H_2SO_4 \rightarrow 2ClO_2 + HCHO + Na_2SO_4 + 2H_2O$--

Column 10, line 1 : "$NaClO_3 + 5NaCl + 3H_2SO_4 \rightarrow 3Cl_2 + 3Na_2SO_4 + 3H_2O$" should be --$NaClO_3 + 5NaCl + 3H_2SO_4 \rightarrow 3Cl_2 + 3Na_2SO_4 + 3H_2O$-- line 67 : "30" should be -- + --

Column 13, line 11 : "sytem" should be --system--

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*